US010358703B2

(12) United States Patent
Zhang et al.

(10) Patent No.: US 10,358,703 B2
(45) Date of Patent: Jul. 23, 2019

(54) MAGNESIUM ALLOY AND METHOD OF PREPARING THE SAME

(71) Applicant: BYD COMPANY LIMITED, Shenzhen, Guangdong (CN)

(72) Inventors: Faliang Zhang, Shenzhen (CN); Youping Ren, Shenzhen (CN); Qing Gong, Shenzhen (CN)

(73) Assignee: BYD COMPANY LIMITED, Shenzhen, Guangdong (CN)

( * ) Notice: Subject to any disclaimer, the term of this patent is extended or adjusted under 35 U.S.C. 154(b) by 185 days.

(21) Appl. No.: 15/525,471

(22) PCT Filed: Apr. 8, 2015

(86) PCT No.: PCT/CN2015/076107
§ 371 (c)(1),
(2) Date: May 9, 2017

(87) PCT Pub. No.: WO2016/074424
PCT Pub. Date: May 19, 2016

(65) Prior Publication Data

US 2017/0321305 A1 Nov. 9, 2017

(30) Foreign Application Priority Data

Nov. 13, 2014 (CN) ..... 2014 1 0640282

(51) Int. Cl.
*C22C 23/06* (2006.01)
*C22F 1/06* (2006.01)

(52) U.S. Cl.
CPC ..... *C22C 23/06* (2013.01); *C22F 1/06* (2013.01)

(58) Field of Classification Search
CPC ..... C22C 23/06; C22F 1/06
USPC ..... 420/402
See application file for complete search history.

(56) References Cited

U.S. PATENT DOCUMENTS

2008/0138236 A1* 6/2008 Bae ..... C22C 1/06 420/405
2014/0198438 A1* 7/2014 Aurongzeb ..... G06F 1/20 361/679.02

FOREIGN PATENT DOCUMENTS

| | | | |
|---|---|---|---|
| CN | 101158002 | A | 4/2008 |
| CN | 101270430 | A | 9/2008 |
| CN | 101440450 | A | 5/2009 |
| CN | 101857933 | A | 10/2010 |
| CN | 102317486 | A | 1/2012 |
| CN | 102586662 | A | 7/2012 |
| CN | 103643096 | A | 3/2014 |
| DE | 10 2013 006 170 | A1 | 10/2014 |
| EP | 2000551 | A | 12/2008 |
| JP | 2008001921 | A | 1/2008 |
| WO | 1989011552 | | 11/1989 |
| WO | 2004085689 | | 10/2004 |

OTHER PUBLICATIONS

NPL: Liu et al, Facilitating Basal Slip to increase deformation ability in Mg—Mn—Ce alloy by textural reconstruction using friction sir processing, Metallurgical and Materials Transactions A, 44A, Aug. 2013) (Year: 2013).*

* cited by examiner

*Primary Examiner* — Jie Yang
(74) *Attorney, Agent, or Firm* — Calfee Halter & Griswold LLP

(57) ABSTRACT

The present disclosure provides a magnesium alloy and a preparation method and an application thereof. Based on the total weight of the magnesium alloy, the magnesium alloy includes 2-3.5 wt % of Ce, 0.01-0.2 wt % of R, 0.8-1.5 wt % of Mn, 0-0.01 wt % of Fe, 0-0.01 wt % of Cu, 0-0.01 wt % of Ni, 0-0.01 wt % of Co, 0-0.01 wt % of Sn, 0-0.01 wt % of Ca, and 94.74-97.19 wt % of Mg, wherein R is at least one selected from Al and Zn.

14 Claims, No Drawings

MAGNESIUM ALLOY AND METHOD OF PREPARING THE SAME

CROSS-REFERENCE TO RELATED APPLICATION

This application is a U.S. national phase application of International Application No. PCT/CN2015/076107, filed on Apr. 8, 2015, which is based on and claims priority to and benefits of Chinese Patent Application No. 201410640282.1, filed with the State Intellectual Property Office (SIPO) of the People's Republic of China on Nov. 13, 2014. The entire contents of the above-identified applications are incorporated herein by reference.

FIELD

The present disclosure relates the field of materials, and more particularly to a magnesium alloy, a preparation method of the magnesium alloy and applications thereof.

BACKGROUND

The most striking feature of magnesium metal relative to other engineering metals is its light weight, especially when viewed in light of its density which is only 1.78 g/cm$^3$, being about 2/9 of steel and 2/3 of aluminum. Magnesium is the lightest metal material which has engineering application value. Moreover, magnesium alloy has a series of advantages such as high specific strength, specific stiffness, good damping performance, and strong radiation resistance, just to name a few. With the continuing to develop electronic products that are light, thin and multi-function, high strength and high thermal conductivity magnesium alloy becomes an important candidate as a structural material.

The structural members of the electronic products are usually complex and precise, therefore the structural members are usually made of die casting alloys. Currently the die casting magnesium alloy in common use is AZ91 series alloy, this kind of alloy has good casting properties and mechanical strength. Its strength can even exceed ZL104 aluminum alloy after aging treatment, so it get to be used widely. However, the thermal conductivity of AZ91 series alloys is only 70 W/(m·K), and is much lower than die casting aluminum alloy which has a thermal conductivity of more than 100 W/(m·K). Therefore, the existing low thermal conductivity magnesium alloy as a component of electronic products greatly affects the electronic products on the requirements of heat dissipation.

In addition, in order to be useful as a structural member in electronic products, the magnesium alloy also needs to have good corrosion resistance, so as to meet the requirements of processing and application. However, there remains an unmet need for improvement of magnesium alloys in this regard.

SUMMARY

The present disclosure aims to overcome the technical problems of low thermal conductivity of existing magnesium alloy materials, and provides a magnesium alloy and preparation method and application thereof. The magnesium alloy has high mechanical performance, corrosion resistance, and high thermal conductivity.

A first aspect of the present disclosure provides a magnesium alloy. According to the embodiments of the present disclosure, based on the total weight of the magnesium alloy, the magnesium alloy includes:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca,
94.74-97.19 wt % of Mg, wherein R is selected from Al, Zn, and combinations thereof.

A second aspect of the present disclosure provides a magnesium alloy. According to the embodiments of the present disclosure, based on the total weight of the magnesium alloy, the magnesium alloy includes:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca, and wherein the balance of the alloy is Mg, and wherein R is selected from Al, Zn, and combinations thereof.

A third aspect of the present disclosure provides a preparation method of the magnesium alloy mentioned above. According to an embodiment of the present disclosure, the preparation method includes: melting the raw material of the magnesium alloy in a predetermined proportion, so as to obtain alloy melt; carrying out molding treatment to the alloy melt, so as to obtain the magnesium alloy.

A forth aspect of the present disclosure relates to the use of the magnesium alloy according to the embodiments of the present disclosure as a heat conductive structure.

A fifth aspect of the present disclosure provides a heat conductive structure member. According to the embodiments of the present disclosure, the heat conductive structure member includes the magnesium alloy mentioned above.

The magnesium alloy provided by the present disclosure has good comprehensive mechanical properties, not only has high strength and hardness, but also has a high elongation, it can be processed into structural members with various shapes and thicknesses. More importantly, the magnesium alloy provided by the present disclosure has good thermal conductivity, its thermal conductivity is generally above 100 W/(m·K), even can reach above 120 W/(m·K). Meanwhile, the magnesium alloy provided by the present disclosure also has good corrosion resistance, it can meet the requirements of a variety of use environments.

The magnesium alloy provided by the present disclosure is suitable for being used as a structural material with high requirements for thermal conductivity, in particular, as a structural member of electronic products.

DETAILED DESCRIPTION

Reference will be made in detail to embodiments of the present disclosure. The embodiments described herein are explanatory, illustrative, and used to generally understand the present disclosure. The embodiments shall not be construed to limit the present disclosure. The same or similar elements and the elements having same or similar functions are denoted by like reference numerals throughout the descriptions.

The present disclosure provides a magnesium alloy, based on the total weight of the magnesium alloy, the magnesium alloy includes:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca,
94.74-97.19 wt % of Mg, wherein R is selected from Al, Zn, and combinations thereof.

In other words, according to the magnesium alloy of the embodiments of the present disclosure, based on the total weight of the magnesium alloy, the magnesium alloy includes the following elements and the weight percent of each element is:

| | |
|---|---|
| Ce | 2-3.5%, |
| R | 0.01-0.2%, |
| Mn | 0.8-1.5%, |
| Fe | 0-0.01%, |
| Cu | 0-0.01%, |
| Ni | 0-0.01%, |
| Co | 0-0.01%, |
| Sn | 0-0.01%, |
| Ca | 0-0.01%, |
| Mg | 94.74-97.19%, |

R is selected from Al, Zn, and combinations thereof.

The magnesium alloy of the present disclosure includes Ce. While not wishing to be bound by theory, the inventor has found that, the inclusion of Ce can increase the crystallization temperature interval of magnesium alloy, so the casting properties of the inventive magnesium alloy can be remarkably improved. Meanwhile, the Ce has a large solid solubility in the inventive magnesium alloy, moreover, with the decrease of temperature after melting, a strengthening phase can be precipitated. Therefore, the addition of Ce can improve the yield strength and casting characteristics of magnesium alloy. In some embodiments of the present disclosure, based on the total weight of the magnesium alloy, the content of the rare earth element is not less than 2 wt %, preferably not less than 2.2 wt %. The inventor also found in the experimental process, in order to further improve the heat conductivity of magnesium alloy, in some embodiments of the present disclosure, based on the total weight of the magnesium alloy, the content of the Ce element can be no higher than 3.5 wt %. Preferably, based on the total weight of the magnesium alloy, the content of the Ce element can be no higher than 3 wt %.

The magnesium alloy according to the embodiments of the present disclosure includes at least one of Al and Zn. While not wishing to be bound by theory, the inventor has found that, Al and Zn can improve the casting properties and mechanical properties of the inventive magnesium alloy. In the present disclosure, an element selected from Al and Zn, and combinations thereof are denoted as R. Based on the total weight of the magnesium alloy, the content of R is more than 0.01 wt %, preferably more than 0.1 wt %. On the premise that the magnesium alloy has high mechanical properties, in order to further improve the thermal conductivity and corrosion resistance of magnesium alloy, the content of R is not higher than 0.2 wt %.

The magnesium alloy according to the embodiments of the present disclosure includes Mn. While not wishing to be bound by theory, the inventor has found that, the corrosion resistance of the inventive magnesium alloy can be improved by addition of a proper amount of Mn, moreover, the Mn element can form a precipitate of high melting point with a impurity Fe in the magnesium alloy and separate out, so as to purify the magnesium alloy melt. Meanwhile, the introduction of a proper amount of Mn can improve the casting properties of the inventive magnesium alloy. In some embodiments of the present disclosure, based on the total weight of the magnesium alloy, the content of the Mn is more than 0.8 wt %, preferably more than 0.9 wt %. However, the inventor also found in the experimental process, when the content of Mn in magnesium alloy is too high, the thermal conductivity of magnesium alloy is decreased, and it also has negative impact on corrosion resistance. In some embodiments of the present disclosure, based on the total weight of the magnesium alloy, the content of the Mn is not more than 1.5 wt %, preferably not more than 1.4 wt %.

While not wishing to be bound by theory, the inventor found that, Fe, Cu, Ni, Co, Sn and Ca have adverse effects on the corrosion resistance of magnesium alloy, when the content thereof is too high, it also has an adverse effect on the thermal conductivity of magnesium alloy. According to the magnesium alloy of embodiments of the present disclosure, based on the total weight of the magnesium alloy, in the magnesium alloy, the respective content of Fe, Cu, Ni, Co, Sn and Ca is not higher than 0.01 wt %.

According to the embodiments of the present disclosure, a small amount of other metal elements are allowed in the magnesium alloy of the present disclosure, such as at least one of Y, Sc, La, Pr, Nd, Pm, Sm, Eu, Gd, Tb, Dy, Ho, Er, Tm, Yb, Lu, Be, Zr, Li, Na, K, Sr, Ba, Ga, In, Ge, Sb, Bi, V, Nb, Cr, Mo, W, Re, Tc, Ru, Pd, Pt, Ag and Au. Based on the total weight of the magnesium alloy, a total weight of other metal elements mentioned above is generally not more than 0.2 wt %, preferably not more than 0.1 wt %.

Fe, Cu, Ni, Co, Sn and Ca as well as the aforementioned other metal elements can be derived from the impurities in the alloy raw material when preparing the alloy, can also be derived from a raw material added as an element of the alloy when preparing the alloy.

The present disclosure also provides a magnesium alloy. According to the embodiments of the present disclosure, based on the total weight of the magnesium alloy, the magnesium alloy includes:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca, and
a balance of Mg, wherein R is selected from Al, Zn, and combinations thereof.

In other words, according to the embodiments of the present disclosure, based on the total weight of the magnesium alloy, the magnesium alloy includes the following elements and the weight percent of each element is:

| | |
|---|---|
| Ce | 2-3.5%, |
| R | 0.01-0.2%, |
| Mn | 0.8-1.5%, |
| Fe | 0-0.01%, |
| Cu | 0-0.01%, |
| Ni | 0-0.01%, |
| Co | 0-0.01%, |
| Sn | 0-0.01%, |
| Ca | 0-0.01%, |

wherein the balance of the alloy is Mg, wherein R is selected from Al, Zn, and combinations thereof.

According to the embodiments of the present disclosure, the magnesium alloy may include one or more combinations of the other metal elements, and also may not include any of the other metal elements. All the additional technical features and advantages of the magnesium alloy provided by the first aspect of the present invention are applicable to certain other embodiments of the magnesium alloy mentioned here.

The present disclosure also provides a preparation method of the aforementioned magnesium alloy. According to the embodiments of the present disclosure, the preparation method includes: melting the raw material of the magnesium alloy in a predetermined proportion, so as to obtain alloy melt; carrying out molding treatment to the alloy melt, so as to obtain the magnesium alloy. Specifically, the raw material of the magnesium alloy can be melted, and the molten alloy liquid can be cast to obtain the magnesium alloy after cooling. In which, the composition of the raw material of the magnesium alloy in a predetermined proportion makes the obtained magnesium alloy as the magnesium alloy provided by the present disclosure. The method of selecting the composition of the alloy material so as to obtain an alloy having a desired composition is well known by the skilled person in this field, there is no need to describe here in detail.

According to the embodiments of the present disclosure, the melting process can be carried out at a temperature of 700° C.-750° C., the melting time is generally 20-60 minutes. In order to avoid oxidation of magnesium alloy melt in contact with air during the melting process, in the process of melting, a covering agent can be used to protect the melt. Melt protection can also be carried out with nitrogen, sulfur hexafluoride gas or inert gas. The covering agent can be used as a conventional choice in the field of magnesium alloy smelting, such as can be at least one of $MgCl_2$, KCl, NaCl and $CaF_2$. In order to further improve the uniformity of the composition of the magnesium alloy, in the smelting process, stirring and argon bubbling are carried out. The argon is preferably pure argon with a purity of more than 99.99%.

According to the embodiments of the present disclosure, in order to further improve the strength of the final prepared magnesium alloy, preferably carry out aging treatment to the prepared magnesium alloy, the aging treatment is carried out at a temperature of 120° C.-350° C. The duration of the aging treatment can be determined by eliminating the internal stress of the magnesium alloy and improving the strength of the magnesium alloy. Generally, the duration of the aging treatment can be at least 0.5 hours, and can last for several hours, days, or even years. After the aging treatment is completed, the magnesium alloy can be naturally cooled.

The magnesium alloy provided by the present invention not only has good comprehensive mechanical properties, but also the yield strength can reach more than 100 MPa, generally in a range of 120 MPa-160 MPa. The elongation rate can reach more than 5%, generally in a range of 5%-10%. In addition, the magnesium alloy has excellent thermal conductivity, the thermal conductivity can reach 100 W/(m·K), generally in a range of 105 W/(m·K)-135 W/(m·K). Meanwhile, the magnesium alloy of the present disclosure also has good corrosion resistance.

The magnesium alloy according to the embodiments of the present disclosure is especially suitable for being used as a heat conductive structure material, and being used to prepare a heat conductive structure member, such as the structure members of a variety of electronic products. Therefore, the present disclosure also provides an application of the magnesium alloy mentioned above as a material of a heat conductive structure, and a heat conductive structure member including the aforementioned heat conductive structure member.

The embodiments of the present disclosure will be described in detail, but the scope of the present disclosure is not limited.

In the following examples and comparative examples, the hardness test, thermal conductivity test, tensile property test and corrosion resistance test of the magnesium alloy was carried out by the following methods.

(1) Hardness test: adopt Vickers hardness tester, test the magnesium alloy wafer with a diameter of 12.7 mm and thickness of 3 mm for three times under the condition that the pressing force is 3 kg and the holding time is 15 s. The average value of the data obtained is the hardness of the tested magnesium alloy, the unit is HV.

(2) Thermal conductivity test: according to a testing method of ASTM E 1461-07, carry out a thermal conductivity test to the magnesium alloy wafer with a diameter of 12.7 mm and thickness of 3 mm adopting laser flash method.

(3) Tensile property test: according to a test method of ISO 6892-1, the molten magnesium alloy melt is injected into the mold cavity using a pressure casting device, a tensile casting member with a wall thickness of 3 mm is obtained. The tensile testing is performed by a universal mechanical testing machine, then yield strength and elongation is obtained, in which, the yield strength is the yield limit causing 0.2% residual deformation, the elongation is an elongation at break.

(4) Corrosion resistance test: the obtained magnesium alloy was cast into a 100 mm×100 mm×1.5 mm sheet, soak it in a 5 wt % NaCl aqueous solution, soak for 48 hours (i.e., 2 days), the corrosion rate was calculated by a weight loss method, the calculation method is as follows:

$$V=(m_1-m_2)/(t\times s)$$

in which, m1 is the quality of magnesium alloy sample before soaking, the unit is mg;

m2 is the quality of magnesium alloy after soaking and being washed by distilled water and dried to constant weight at 120° C., the unit is mg;

t is the soaking time, the unit is day;

s is a surface area of the magnesium alloy sample, the unit is $cm^2$;

V is the corrosion rate, the unit is $mg/(cm^2\cdot d)$.

The following will describe examples of the present disclosure in detail.

EXAMPLE 1

Prepare the alloy raw material according to the composition of magnesium alloy $Mg_{over}Al_{0.1}Mn_1Ce_2$ (the index is the weight percentage of each element based on the total weight of magnesium alloy). The prepared alloy material is placed in the smelting furnace and melted at a temperature of 720° C. for 30 min, high purity argon with a purity of 99.99% is introduced into the smelting process, the resulting melt is injected into a metal mold, the magnesium alloy casting member is obtained after cooling.

Carry out aging treatment to the obtained magnesium alloy casting member at a temperature of 200° C. for 5 hours. After aging treatment, natural cooling to room temperature.

The hardness, thermal conductivity, yield strength, elongation and corrosion rate of the prepared magnesium alloy is tested respectively, the results is as shown in Table 1.

EXAMPLES 2-16

Prepare the magnesium alloy adopting the same method as Example 1, the difference is that, prepare the alloy raw material according to the composition of magnesium alloy given in table 1. In which, the magnesium alloy of Example 12 is carried out aging treatment at a temperature of 120° C. for 36 hours, the magnesium alloy of Example 21 is carried out aging treatment at a temperature of 350° C. for 6 hours.

The hardness, thermal conductivity, yield strength, elongation and corrosion rate of the prepared magnesium alloy is shown in Table 1.

COMPARATIVE EXAMPLES 1-8

Prepare the magnesium alloy adopting the same method as Example 1, the difference is, prepare the alloy raw material according to the composition of magnesium alloy given in table 1.

The hardness, thermal conductivity, yield strength, elongation and corrosion rate of the prepared magnesium alloy is shown in Table 1.

EXAMPLE 17

Prepare the magnesium alloy adopting the same method as Example 1, the difference is, the prepared magnesium alloy casting member is not carried out aging treatment.

The hardness, thermal conductivity, yield strength, elongation and corrosion rate of the prepared magnesium alloy is shown in Table 1.

TABLE 1

| Number | Alloy Composition//wt % | Hardness/ HV | Thermal Conductivity/ W/(m · K) | Yield Strength/ MPa | Elongation/ % | Corrosion Rate/ mg/(cm$^2$ · d) |
|---|---|---|---|---|---|---|
| Example 1 | $Mg_{over}Al_{0.1}Mn_1Ce_2$ | 55 | 125 | 120 | 8 | 0.1 |
| Example 2 | $Mg_{over}Al_{0.1}Mn_1Ce_{2.2}$ | 58 | 125 | 120 | 7 | 0.06 |
| Example 3 | $Mg_{over}Al_{0.1}Mn_1Ce_3$ | 63 | 120 | 135 | 7 | 0.05 |
| Example 4 | $Mg_{over}Al_{0.1}Mn_1Ce_{3.5}$ | 75 | 105 | 160 | 5 | 0.1 |
| Example 5 | $Mg_{over}Al_{0.1}Mn_1La_{0.05}Ce_2Pr_{0.05}Nd_{0.05}$ | 65 | 115 | 140 | 8 | 0.6 |
| Example 6 | $Mg_{over}Al_{0.01}Mn_1Ce_{2.5}$ | 45 | 128 | 105 | 10 | 0.08 |
| Example 7 | $Mg_{over}Al_{0.1}Mn_1Ce_{2.5}$ | 60 | 120 | 125 | 8 | 0.1 |
| Example 8 | $Mg_{over}Al_{0.2}Mn_1Ce_{2.5}$ | 66 | 115 | 138 | 7 | 0.15 |
| Example 9 | $Mg_{over}Zn_{0.2}Mn_1Ce_{2.5}$ | 63 | 102 | 136 | 7 | 1 |
| Example 10 | $Mg_{over}Zn_{0.1}Mn_1Ce_{2.2}$ | 55 | 120 | 130 | 8 | 0.6 |
| Example 11 | $Mg_{over}Zn_{0.05}Mn_1Ce_2Cu_{0.008}Co_{0.005}$ | 52 | 130 | 112 | 8 | 0.02 |
| Example 12 | $Mg_{over}Al_{0.2}Mn_{1.5}Ce_2$ | 67 | 115 | 140 | 6 | 0.5 |
| Example 13 | $Mg_{over}Al_{0.1}Mn_{0.8}Ce_3$ | 75 | 108 | 155 | 5 | 0.2 |
| Example 14 | $Mg_{over}Al_{0.1}Mn_{1.4}Ce_3$ | 72 | 108 | 150 | 5 | 0.8 |
| Example 15 | $Mg_{over}Al_{0.1}Mn_1Ce_{2.2}Be_{0.01}Zr_{0.05}$ | 64 | 124 | 138 | 7 | 0.01 |
| Example 16 | $Mg_{over}Al_{0.1}Mn_1Ce_{2.5}Ni_{0.005}Ca_{0.006}Sn_{0.01}$ | 63 | 120 | 135 | 7 | 0.03 |
| Comparative Example 1 | $Mg_{over}Al_{0.2}Mn_1Ce_4$ | 80 | 90 | 170 | 5 | 1.6 |
| Comparative Example 2 | $Mg_{over}Al_{0.2}Mn_1Ce_{1.5}$ | 45 | 130 | 100 | 9 | 0.5 |
| Comparative Example 3 | $Mg_{over}Al_{0.4}Mn_1Ce_{2.5}$ | 70 | 95 | 144 | 6 | 1 |
| Comparative Example 4 | $Mg_{over}Mn_1Ce_{2.5}$ | 40 | 125 | 100 | 12 | 0.08 |
| Comparative Example 5 | $Mg_{over}Zn_{0.35}Mn_1Ce_{2.5}$ | 68 | 80 | 138 | 7 | 3 |
| Comparative Example 6 | $Mg_{over}Mn_1Ce_2Cu_{0.008}Co_{0.005}$ | 40 | 127 | 100 | 8 | 0.1 |
| Comparative Example 7 | $Mg_{over}Al_{0.2}Mn_{1.8}Ce_2$ | 65 | 90 | 139 | 5 | 2 |
| Comparative Example 8 | $Mg_{over}Al_{0.1}Mn_{0.5}Ce_3$ | 60 | 115 | 130 | 8 | 2 |
| Example 17 | $Mg_{over}Al_{0.1}Mn_1Ce_2$ | 40 | 125 | 100 | 12 | 0.1 |

It can be confirmed that from the data of Table 1, the magnesium alloy according to the present disclosure shows good comprehensive mechanical properties, not only has good strength and hardness, but also has high elongation. Importantly, the magnesium alloy according to the present disclosure shows excellent thermal conductivity. The thermal conductivity reaches more than 100 W/(m·K), under the optimal conditions can reach more than 120 W/(m·K). Meanwhile, the magnesium alloy according to the present disclosure also has good corrosion resistance, the corrosion rate can reach below 1 mg/($cm^2$·d), under the optimal conditions can reach below 0.6 mg/($cm^2$·d).

It can be seen by comparing Example 4 with Comparative Example 1, when the content of Ce in magnesium alloy is too high, the thermal conductivity of magnesium alloy is decreased, and the corrosion resistance is also adversely affected. It can be seen by comparing Example 1 with Comparative Example 2, when the content of Ce in magnesium alloy is insufficient, the mechanical strength and corrosion resistance of magnesium alloy are not good enough.

It can be seen from the results of Examples 8 and 9 as well as Comparative Examples 3 and 5, the content of aluminum and/or zinc in magnesium alloy is too high, the thermal conductivity and corrosion resistance of the magnesium alloy is reduced. It can be seen by comparing Example 11 with Comparative Example 6, the mechanical properties and the corrosion resistance of magnesium alloy are decreased when the magnesium alloy has no Zn. It needs to be explained, magnesium alloy has good thermal conductivity even though there is no aluminum in magnesium alloy, but in the absence of aluminum in the magnesium alloy, the casting properties are poor, cold shut and flow line are easily emerged in the casting products, and the alloy melt is easy to burn.

It can be seen from the results of Examples 12 and 13 as well as Comparative Examples 7 and 8, magnesium alloy has good thermal conductivity and corrosion resistance in the introduction of appropriate amounts of Mn. But when the content of manganese in magnesium alloy is too high, the thermal conductivity and the corrosion resistance of magnesium alloy decreases; when the content of manganese in magnesium alloy is too low, the corrosion resistance of magnesium alloy is not good.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A magnesium alloy, based on the total weight of the magnesium alloy, the magnesium alloy comprises:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca,
94.74-97.19 wt % of Mg,
wherein R is selected from the group consisting of Al, Zn, and combinations thereof; and
wherein the magnesium alloy includes, based on the total weight of the magnesium alloy, not more than 0.2 wt % of the combined weight of one or more metals selected from the group consisting of Y, Sc, La, Pr, Nd, Pm, Sm, Eu, Gd, Tb, Dy, Ho, Er, Tm, Yb, Lu, Be, Zr, Li, Na, K, Sr, Ba, Ga, In, Ge, Sb, Bi, V, Nb, Cr, Mo, W, Re, Tc, Ru, Pd, Pt, Ag and Au.

2. The magnesium alloy according to claim 1, wherein the content of Ce in the magnesium alloy is 2.2-3 wt %.

3. The magnesium alloy according to claim 1, wherein the content of R in the magnesium alloy is 0.1-0.2 wt %.

4. The magnesium alloy according to claim 1, wherein the content of Mn in the magnesium alloy is 0.9-1.4 wt %.

5. The magnesium alloy according to claim 1, wherein the alloy is formed into a heat conductive structure member.

6. A magnesium alloy, based on the total weight of the magnesium alloy, the magnesium alloy consists of:

2-3.5 wt % of Ce,
0.01-0.2 wt % of R,
0.8-1.5 wt % of Mn,
0-0.01 wt % of Fe,
0-0.01 wt % of Cu,
0-0.01 wt % of Ni,
0-0.01 wt % of Co,
0-0.01 wt % of Sn,
0-0.01 wt % of Ca, and
a balance of Mg,
wherein R is selected from the group consisting of Al, Zn, and combinations thereof.

7. The magnesium alloy according to claim 6, wherein the content of Ce in the magnesium alloy is 2.2-3 wt %.

8. The magnesium alloy according to claim 6, wherein the content of R in the magnesium alloy is 0.1-0.2 wt %.

9. The magnesium alloy according to claim 6, wherein the content of Mn in the magnesium alloy is 0.9-1.4 wt %.

10. The magnesium alloy according to claim 6, wherein the alloy is formed into a heat conductive structure member.

11. A method of preparing a magnesium alloy, comprising:

melting the raw material of the magnesium alloy in a predetermined proportion, so as to obtain alloy melt;
carrying out molding treatment to the alloy melt, so as to obtain the magnesium alloy;
wherein the magnesium alloy is the magnesium alloy according to claim 1.

12. The method according to claim 11 further comprising carrying out aging treatment to the obtained magnesium alloy.

13. The method according to claim 12, wherein the aging treatment is carried out at a temperature of 120° C.-350° C.

14. The method according to claim 11, wherein the duration of the aging treatment is at least 0.5 hours.

* * * * *